US006321763B1

(12) United States Patent
Ma

(10) Patent No.: US 6,321,763 B1
(45) Date of Patent: Nov. 27, 2001

(54) UMBRELLA STRUCTURE

(76) Inventor: Joen Shen Ma, Fl. 12, No. 578, GuangFu S. Road, Taipei (TW)

( * ) Notice: Subject to any disclaimer, the term of this patent is extended or adjusted under 35 U.S.C. 154(b) by 0 days.

(21) Appl. No.: 09/589,161

(22) Filed: Jun. 8, 2000

(30) Foreign Application Priority Data

May 3, 2000 (TW) ..... 089207299

(51) Int. Cl.[7] ..... A45B 25/00; A45B 17/00
(52) U.S. Cl. ..... 135/20.1; 135/21; 135/20.3
(58) Field of Search ..... 135/20.1, 21, 20.3

(56) References Cited

U.S. PATENT DOCUMENTS

| | | | | |
|---|---|---|---|---|
| 5,116,258 | * | 5/1992 | Vennick | 135/21 X |
| 5,735,302 | * | 4/1998 | Saliva | 135/21 X |
| 5,785,069 | * | 7/1998 | Glatz | 135/20.3 X |
| 5,937,882 | * | 8/1999 | Harbaugh | 135/20.3 |
| 5,960,806 | * | 10/1999 | Steiner | 135/20.1 |
| 6,014,980 | * | 1/2000 | Glatz | 135/21 X |
| 6,196,242 | * | 3/2001 | Xu | 135/21 X |

FOREIGN PATENT DOCUMENTS

| | | | | |
|---|---|---|---|---|
| 0334821 | * | 9/1989 | (EP) | 135/20.1 |

* cited by examiner

*Primary Examiner*—Robert Canfield
(74) *Attorney, Agent, or Firm*—Rosenberg, Klein & Lee

(57) ABSTRACT

An umbrella includes a panel attached to a crown and supported by ribs. A runner is coupled to the ribs by stretchers to be movable with respect to the crown. A pole located beside the panel is arranged upright with a slide mounted thereon to be movable along the pole. An arm has an end pivoted to the slide and is further supported by a link pivoted to both the pole and the arm. A first rope to which the slide is attached is movably received in the pole and supported by an upper pulley and a crank whereby by actuating the crank the first rope moves the slide along the pole. A second rope movably received in the arm having an end fixed to the pole via a pulley fixed on the slide and an opposite end extending beyond the arm and through the crown to be fixed to the runner whereby by moving the slide along the pole, the arm is rotated between a closed position and an open position where the runner is moved toward the crown by the second rope. Spaced tabs are formed on the arm to be received in grooves defined in the crown when the arm is moved to the open positioned for securely attaching the panel to the arm thereby allowing the panel to be moved with the arm for adjusting the orientation thereof. A locking device is provided in the arm for selectively securing the second rope.

7 Claims, 8 Drawing Sheets

UMBRELLA STRUCTURE

FIELD OF THE INVENTION

The present invention generally relates to a rope-operated large-sized umbrella, such as a beach umbrella and a garden umbrella, and in particular an umbrella of the type with an orientation-adjustable umbrella panel.

BACKGROUND OF THE INVENTION

Conventional umbrellas comprise a center post on which radially extending ribs are mounted for supporting a panel. A runner is movably mounted on the center post for manual operation of opening the umbrella. For a large-sized umbrella, such as a beach umbrella and a garden umbrella, the center post occupies the centermost space and often interferes with activity occurring under the umbrella panel. Thus a full exploitation of the space covered by the panel is in general not possible.

Taiwan Patent Application No. 86202611 discloses an umbrella structure in which the panel is supported by a pole located beside the panel, rather than at a center of the panel. A rope system is adapted to control opening/closing of the panel. This structure allows a full exploitation of the space covered by the panel.

However, the panel of the above mentioned large-sized umbrella is fixed at a particular direction. Changing direction of the panel in response to the orientation of the sun is generally impossible.

Thus, it is desired to provide an umbrella structure for overcoming the above problem.

SUMMARY OF THE INVENTION

Accordingly, an object of the present invention is to provide an umbrella supported by a pole located adjacent a panel of the umbrella, the panel being operated by a rope system for opening/closing the panel in a stepless fashion.

Another object of the present invention is to provide an umbrella comprising a panel supported by ribs radially extending from a runner, the runner being coupled to a rope system controlled by a crank device, to be moved toward/away from a crown of the panel for opening/closing the umbrella.

A further object of the present invention is to provide an umbrella comprising a panel mounted to a crown, the crown being selectively and releaseably attached to an end of an arm for being rotated with the arm thereby adjusting the orientation thereof.

Yet a further object of the present invention is to provide an umbrella comprising a panel selectively and releaseably attached to an arm supported by a pole located beside the panel for being movable with the arm to adjust the orientation thereof, the panel and the arm being operated by a rope system that is controlled by a crank device.

In accordance with the present invention, there is provided an umbrella comprising a panel attached to a crown and supported by ribs. A runner is coupled to the ribs by stretchers to be movable with respect to the crown. A pole located beside the panel is arranged upright with a slide mounted thereon to be movable along the pole. An arm has an end pivoted to the slide and is further supported by a link pivoted to both the pole and the arm. A first rope, to which the slide is attached, is movably received in the pole and supported by an upper pulley and a crank, whereby by actuating the crank the first rope moves the slide along the pole. A second rope is movably received in the arm and has an end fixed to the pole via a pulley fixed on the slide. An opposite end of the second rope extends beyond the arm and through the crown to be fixed to the runner, whereby by moving the slide along the pole, the arm is rotated between a closed position and an open position where the runner is moved toward the crown by the second rope. Spaced tabs are formed on the arm to be received in grooves defined in the crown when the arm is moved to the open positioned for securely attaching the panel to the rm, to thereby allow the panel to be moved with the arm for adjusting the orientation thereof. A locking device is provided in the arm for selectively securing the second rope.

BRIEF DESCRIPTION OF THE DRAWINGS

The present invention will be apparent to those skilled in the art by reading the following description of a preferred embodiment thereof, with reference to the accompanying drawings, in which.

DETAILED DESCRIPTION OF THE PREFERRED EMBODIMENTS

Figure 1:
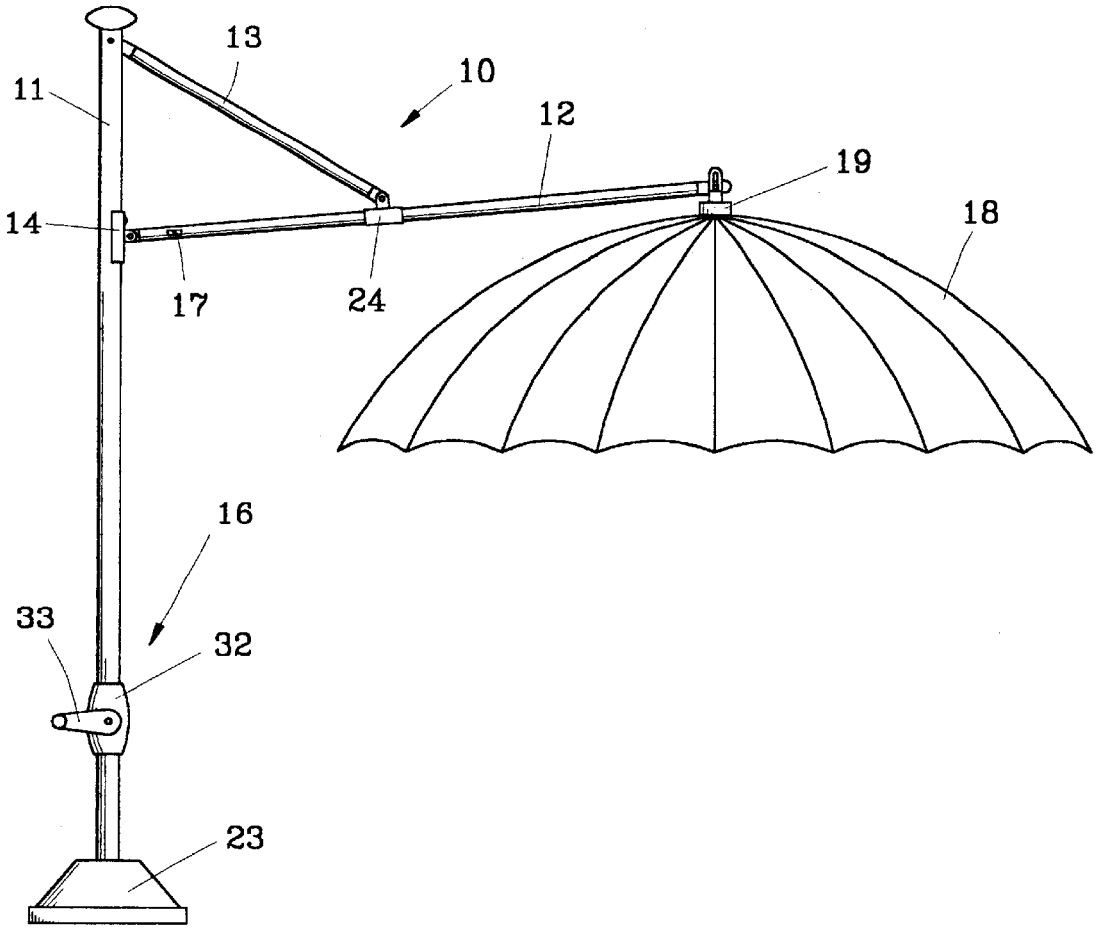
FIG. 1 is a side elevational view of an umbrella constructed in accordance with the present invention showing the umbrella at an open position.

With reference to the drawings and in particular to FIGS. 1–4, wherein an umbrella constructed in accordance with the present invention, generally designated at 10, is shown, the umbrella 10 comprises a support pole 11 and an arm 12 movably mounted to the support pole 11 by a slide 14 and also coupled to the support pole 11 by a link 13, slide 14 for forming a frame to support a panel assembly comprising a panel 18 supported by ribs 20 and stretchers 22. A control rope system 15 comprises primary and secondary ropes 25 and 26 coupled to the panel assembly and operated by a crank driving device 16 for opening/closing the panel 18.

Similar to a conventional umbrella, the ribs 20 of the umbrella 10 of the present invention radially extend from a crown 19 for supporting the panel 18. The stretchers 22 are pivotally connected to the ribs 20 and a runner 21 that is movable with respect to the crown 18 for opening/closing the panel 18. The panel assembly, including the panel 18, the ribs 20, the stretchers 22, the crown 19 and the runner 21, is connected to the movable arm of the support frame by the secondary rope 26 to be supported in a raised position by the pole 11. A remote end of the secondary rope 26 extends through a central bore (not labeled) defined in the crown 19 to be fixed to the runner 21. Whereby, when the secondary rope 26 is pulled in a direction away from the panel 18, the runner 21 is moved from a lower closed position (FIGS. 2 and 4) to an upper open position (FIGS. 1 and 3) for driving the ribs 20 and the stretchers 22 to open the panel 18 as shown in FIG. 1.

The pole 11, in general, stands upright with a lower end thereof supported by a base 23. The base 23 is preferably of substantial mass for stabley supporting the umbrella The slide 14 is attached to the primary rope 25 and slidable along the pole 11 so that when the primary rope 25 is driven by the crank driving device 16, the slide 14 is moved along the pole 11 and thus causing the arm 12 to move with respect to the pole 11.

The arm 12 has a proximate end pivotally connected to the slide 14 and a distal end to which the panel assembly is attached by the secondary rope 26. A pivot joint 24 is formed on the arm 12. The link 13 has two ends respectively pivotally connected to an upper end of the pole 11 and the pivot joint 24. When the slide 14 is moved along the pole 11, the arm 12 is forced to rotate about the pivot joint 24 and the pivotal connection thereof moves with the slide 14, thereby moving between the open position (FIG. 3) and the closed position (FIG. 4). In the open position, a substantially right angle is formed between the pole 11 and the arm 12 (namely, the arm 12 being substantially horizontal), whereby the distal end of the arm 12 and thus the panel 18 is farthest from the pole 11. In the closed position, an angle substantially smaller than a right angle is formed between the arm 12 and the pole 11, whereby the distal end of the arm 12 is moved close to the pole 11.

The pole 11, the arm 12, the link 13 and the slide 14 are all described in Taiwan Patent Application No. 86202611. Thus, unless required for the description of the present invention, these elements will not be further described in detail.

The pole 11 comprises an elongate tubular member having a central bore (not labeled) in which the primary rope 25 is movably received. The primary rope 25 extends over a pulley 27 mounted on the upper end of the pole 11 and has ends fixed to crank driving device 16 to be driven thereby.

The secondary rope 26 has a predetermined length. With the distal end fixed to the runner 21, a proximate end of the secondary rope 26 is fixed to the pole 11, preferably at a location adjacent the lower end of the pole 11. In the embodiment illustrated, a pin 29 fixed in the pole 11 is provided to which the proximate end of the secondary rope 26 is attached.

The arm 12 is an elongate tubular member through which the secondary rope 26 extends. The secondary rope 26 further extends through the central bore of the pole 11. In this respect, a pulley 30 is mounted at the proximate end of the arm 12 for aiding the passage of the secondary rope 26 into the pole 11. A further pulley 31 is mounted at the distal end of the arm 12 for aiding the passage of the secondary rope 26 through the crown 19 to the runner 21.

The crank driving device 16 is fixed to a lower portion of the pole 11 at a position readily accessible by a user for operation thereof. The crank driving device 16 comprises a casing 32 mounted to the pole 11. An axle 28 is rotatably supported in the casing 32 and is coupled to a crank member 33 accessible by a user for rotating the axle 28. The primary rope 25 forms a loop coupled between the axle 28 and the pulley 27. When the crank member 33 is actuated, the primary rope 25 is driven to move between the axle 28 and the pulley 27, which in turn drives the slide 14 to move along the pole 11.

In the embodiment illustrated, the pin 29 for fixing the secondary rope 26 is arranged inside the casing 32 of the crank driving device 16, but it can be arranged in other suitable positions along the pole 11.

Figure 5:
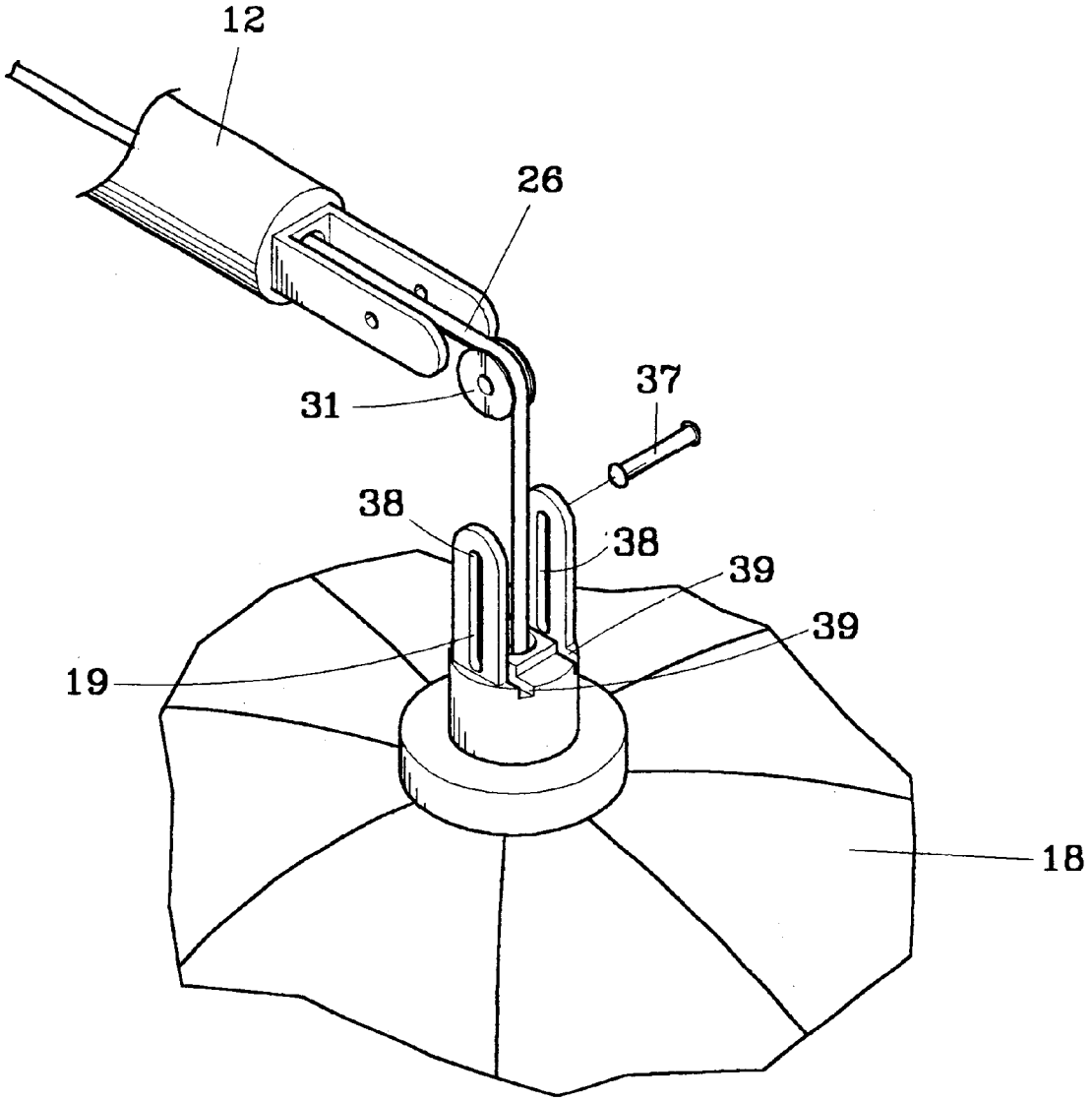
FIG. 5 is an exploded view of the pivotal connection between an arm and a crown of the umbrella of the present invention.
Figure 9:
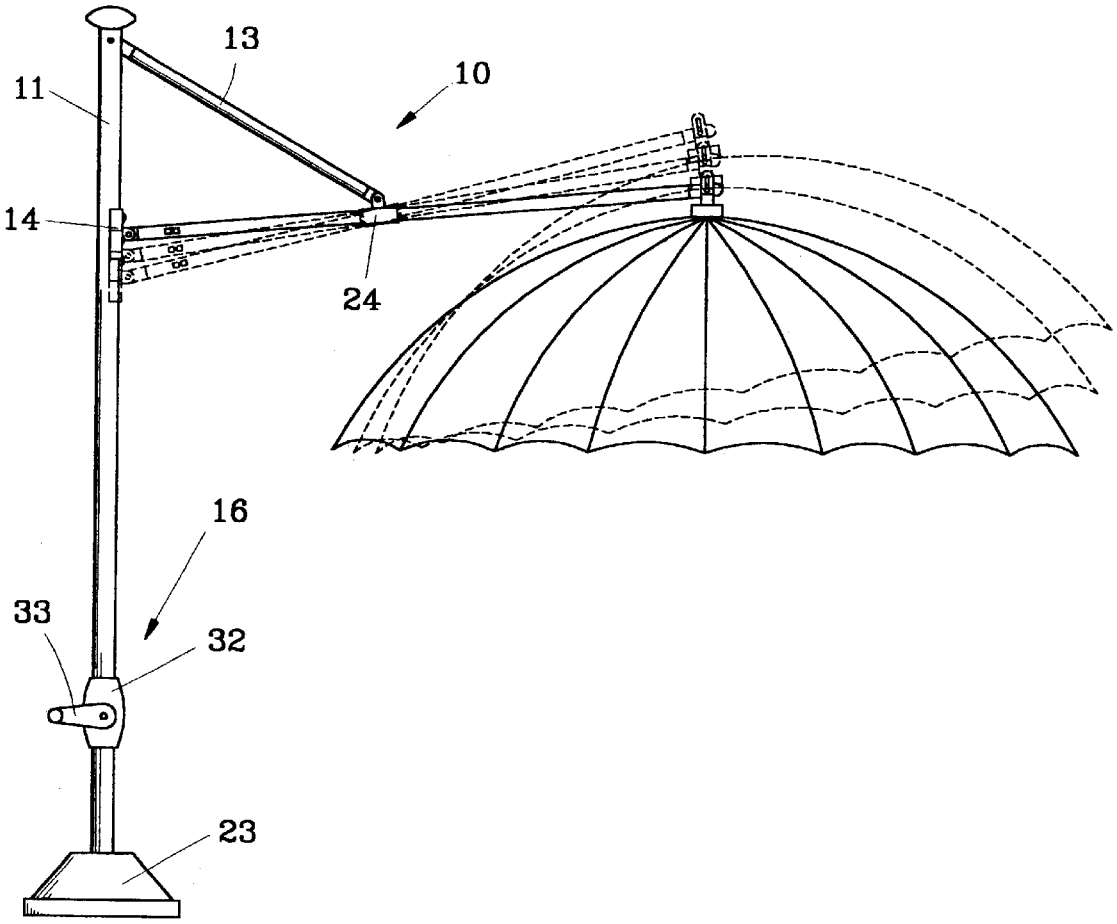
FIG. 9 is a side elevational view of the umbrella of the present invention showing the adjustment of the orientation thereof.

Referring to FIG. 5, two spaced first tabs (not labeled) are formed on the remote end of the arm 12 with the pulley 31 rotatably supported therebetween by a pin 37. The crown 19 forms two spaced second tabs (not labeled) defining aligned slots 38 in which the pin 37 is movably received whereby the crown 19 is movable with respect to the arm 12 between an upper, locked position and a lower, released position defined by opposite ends of the slots 38. Two grooves 39 are defined in the crown 19 whereby when the secondary rope 26 is pulled to move the crown 19 to the locked position, the first tabs of the arm 12 are received in the grooves 39 of the crown 19. By means of the tension of the secondary rope 26 and the reaction force between the first tabs and the grooves 39, the panel assembly is effectively locked to the distal end of the arm 12. The panel 18 may then be swung with the arm 12 about the pivotal connection between the arm 12 and the slide 14 to change orientation thereof, as indicated by dashed lines of FIG. 9.

Figure 6:
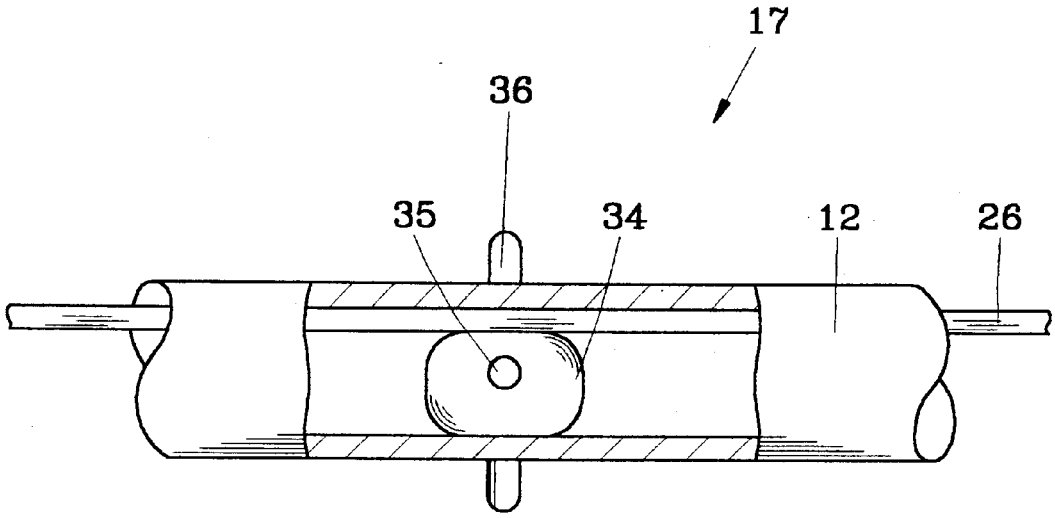
FIG. 6 is a side view, partially sectioned, of a portion of the arm showing a rope locking device of the umbrella of the present invention.

Also referring to FIG. 6, to fix the secondary rope 26 at the tensioned condition associated with the locked condition of the crown 19, a locking device 17 is provided inside the arm 12. The locking device 17 may be manually actuated to engage and thus fix the secondary rope 26. The locking device 17 comprises a locking member 34 pivotally mounted in the arm 12 by an eccentric pin 35. The secondary rope 26 extends through a gap between the locking member 34 and an inner surface of the arm 12. The pin 35 is coupled to a manual knob 36. When the knob 36 is rotated by a user, the locking member 34 is moved in such a way so as to reduce the gap, and thereby pinch the secondary rope 26 between the locking member 34 and the inner surface of the arm 12, and thus effectively lock the secondary rope 26 in the particular position.

It is apparent to those having ordinary skills to arrange the locking device 17 at any suitable location other than the arm 12. For example, the locking device 17 may be attached to the slide 14 for fixing the secondary rope 26 with respect to the arm 12.

Figure 3:
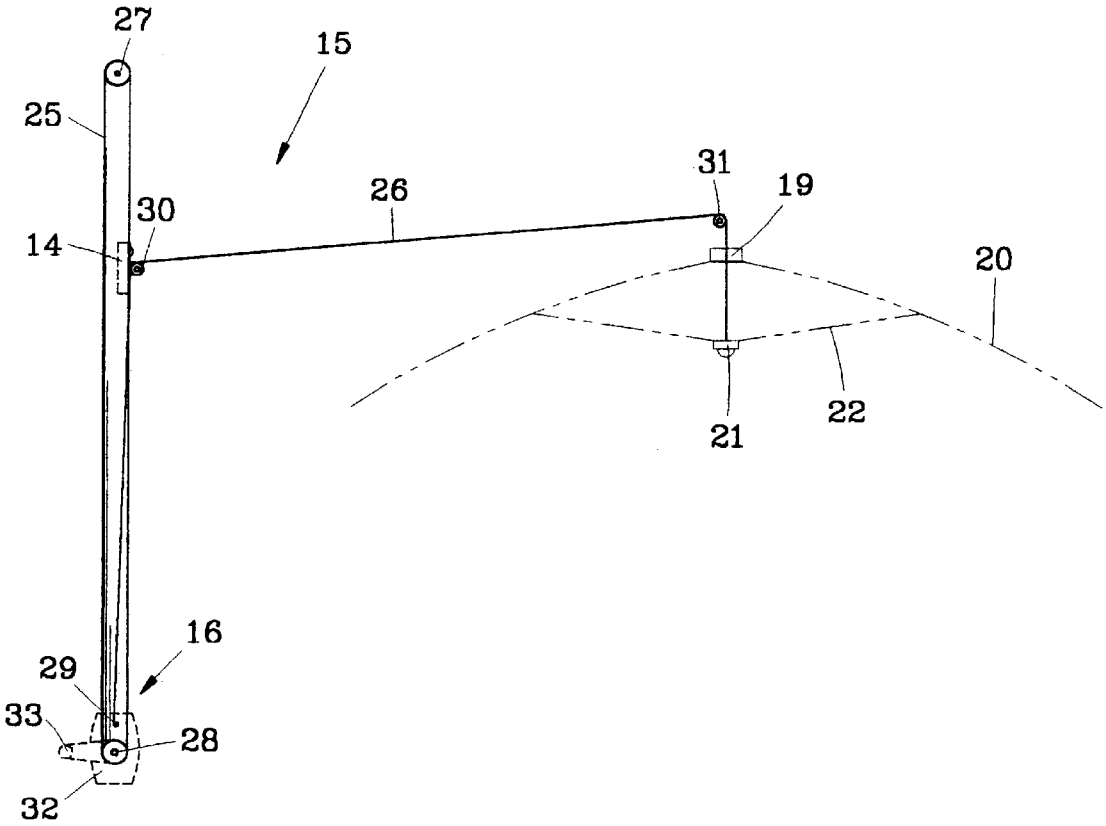
FIG. 3 is a schematic view showing a rope system of the umbrella of the present invention corresponding to the open position of FIG. 1.
Figure 4:
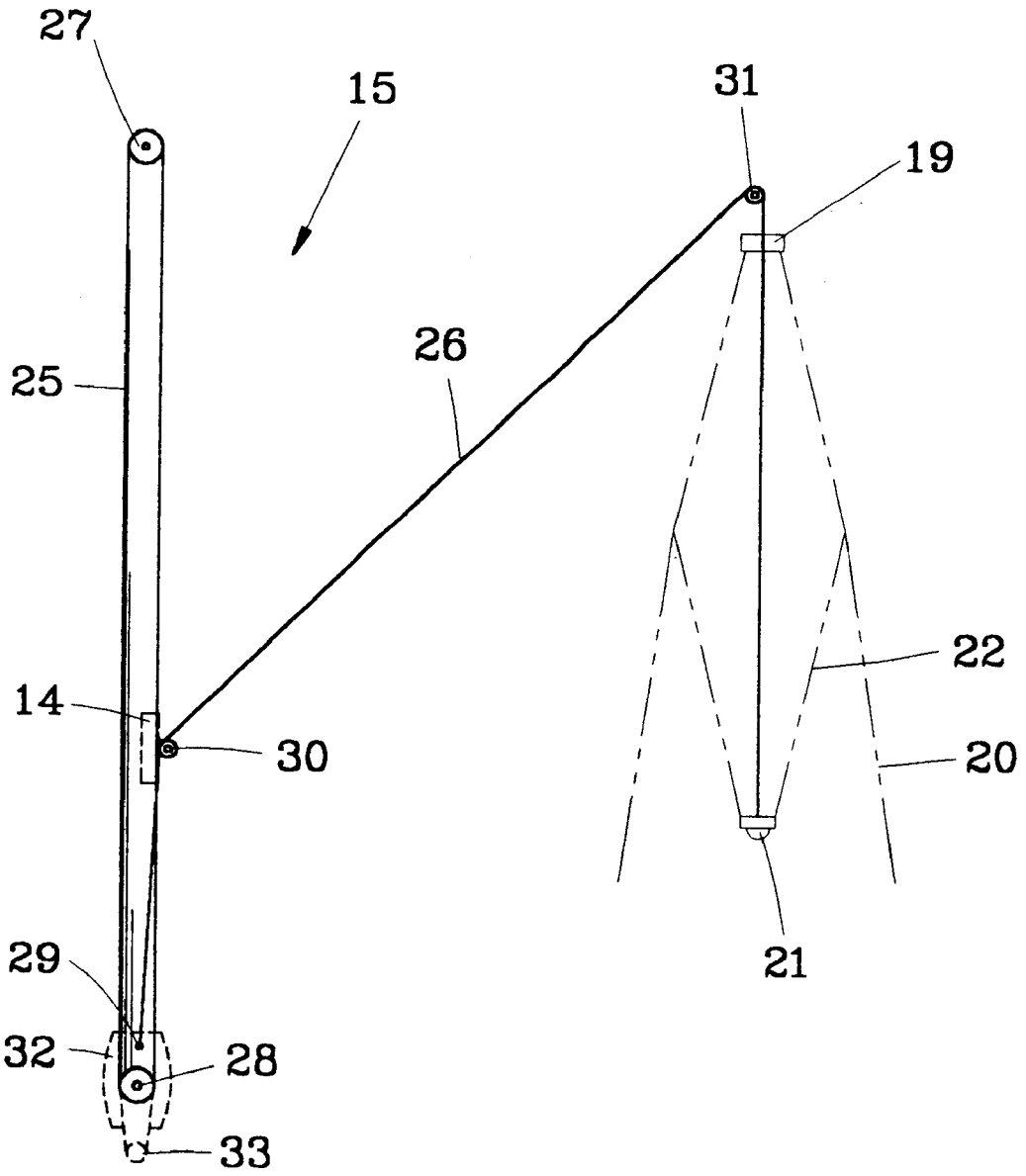
FIG. 4 is similar to FIG. 3 but corresponding to the closed position of FIG. 2.

Referring to FIG. 3, when the slide 14 is driven by the movement of the primary rope 25 to slide toward the upper end of the pole 11, the distance between the slide 14 and the pin 29 that fixes proximate end of the secondary rope 26 to the pole 11 is increased, which causes the runner 21 to move toward the crown 19 and thus open the panel 18, as shown in FIG. 1.

Figure 2:
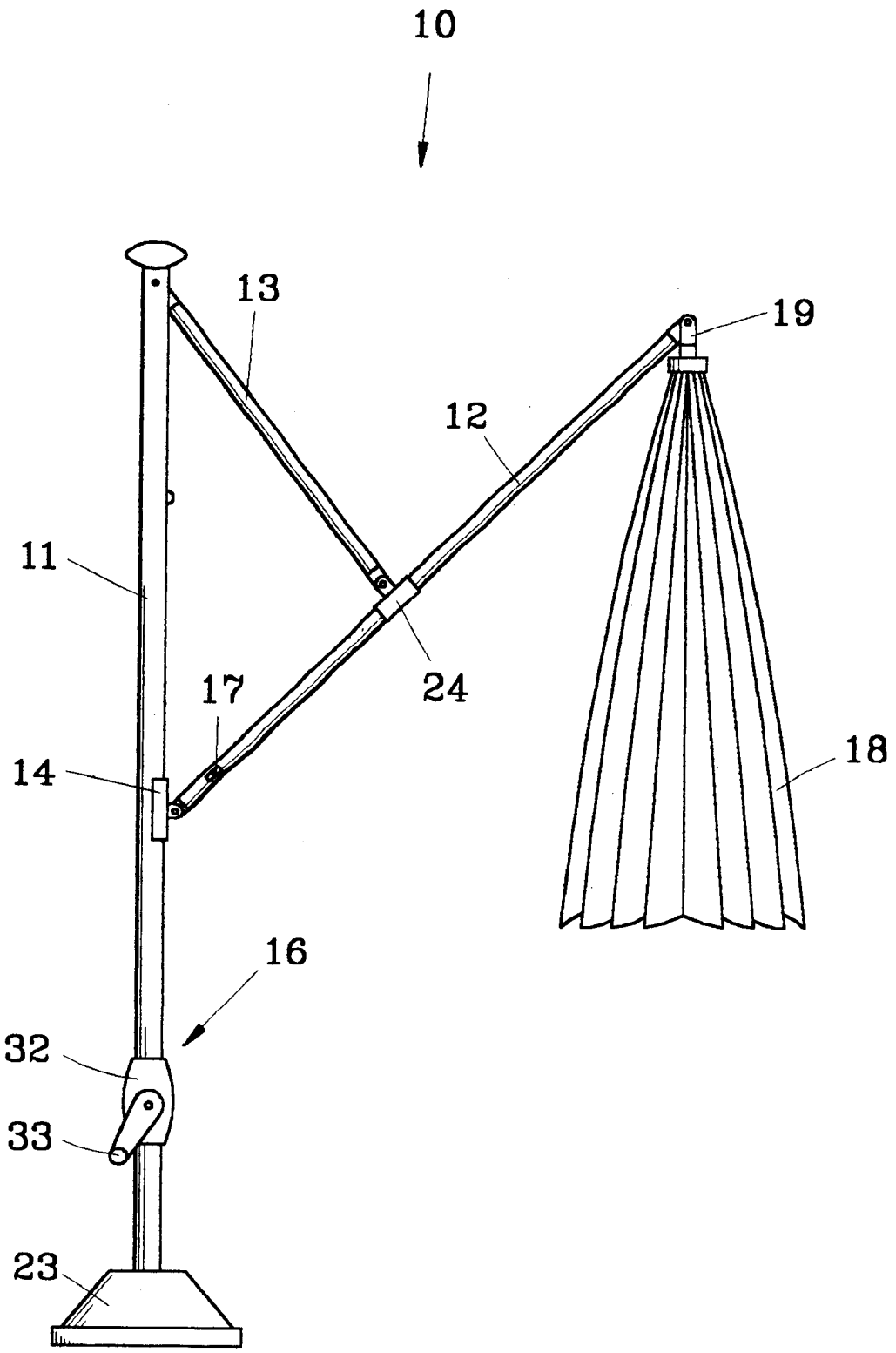
FIG. 2 is similar to FIG. 1 but showing the umbrella at a closed position.

On the other hand, when the slide 14 is moved in an opposite direction, toward the lower end of the pole 11, such releases the runner 21. By means of a spring force provided by the stretchers 22, the panel 18 is driven to close, as shown in FIG. 2.

In addition, when the panel 18 is fully opened, the tabs formed on the distal end of the arm 12 are moved into the grooves 39 of the crown 19. By means of the tension of the secondary rope 26, the panel 18 is securely attached to the distal end of the arm 12. The secondary rope 26 may then be fixed in position by the locking device 17, as described above. Further driving of the primary rope 25 to move the slide 14 causes the panel 18 to rotate to a different direction, as indicated by the dashed lines shown in FIG. 9.

Since the movement of the slide 14 is controlled by the primary rope 25 in a continuous manner, the rotation of the arm 12 with respect to the slide 14 is, in general, stepless. In other words, the panel 18 may be opened to any extent between the open position and closed position in a stepless fashion. Furthermore, the adjustment of the orientation of the panel 18 can also be achieved in a stepless fashion.

It is apparent to those skilled in the art to replace the primary rope 25 and the pulley 27 by a timing belt and the associated gear, or a chain and sprocket. Corresponding thereto, a gear or a sprocket may be mounted to the axle 28 of the crank driving device 16, providing a more precise control of the movement of the slide 14.

Figure 7:
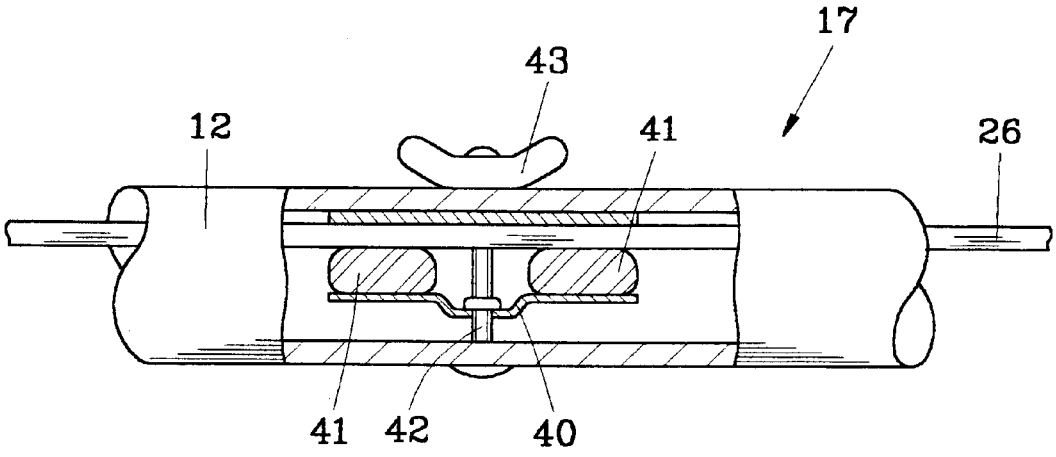
FIG. 7 is similar to FIG. 6 but showing another embodiment of the rope locking device.

FIG. 7 shows another embodiment of the locking device 17. The locking device of FIG. 7 comprises a support member 40 supported inside the arm 12 by a bar 42 extending beyond the arm 12 with a nut 43 attached thereto. Two locking blocks 41 are attached to the support member 40 inside the arm 12. A gap is defined between the locking blocks 41 and the inside surface of the arm 12 through which the secondary rope 26 extends. When the nut 43 is actuated, the bar 42 drives support member 40 to force the locking blocks 41 toward the secondary rope 26, thereby pinching the secondary rope 26 between the locking blocks 41 and the inside surface of the arm 12 and thus effectively fixing the secondary rope 26 in position. On the other hand, releasing the nut 43 allows the locking blocks 41 to move away from the secondary rope 26 and thus releasing the secondary rope 26.

Figure 8:
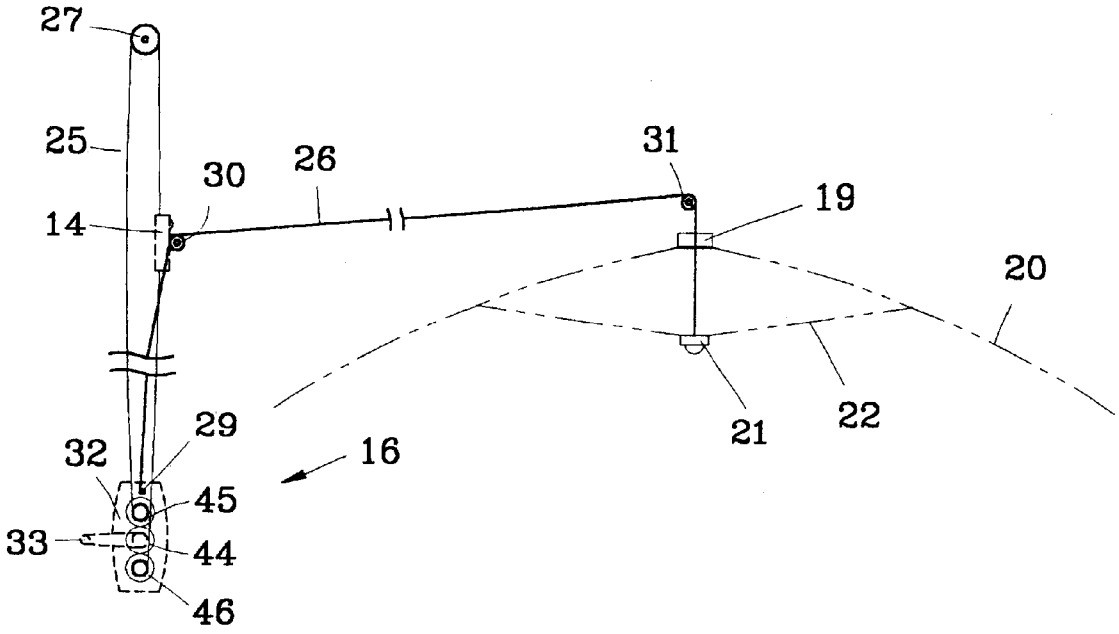
FIG. 8 is similar to FIG. 3 but showing a crank device of different embodiment.

FIG. 8 shows a different embodiment of the crank driving device 16 of the present invention. The crank driving device 16 of FIG. 8 comprises a casing 32 attached to the pole 11 and a crank member 33 extending into the casing 32 with an input gear 44 fixed thereon. Two output gears 45, 46 respectively arranged on upper and lower sides of the input gear 44 and mating with the input gear 44. A predetermined length of each end of the primary rope 25 is fixed to and wound around a shaft of each output gear 45, 46 whereby when the input gear 44 drives the output gears 45, 46 to rotate in opposite directions, the primary rope 25 may be unwound from one of the output gears 45, 46 and further wound to the other one of the output gear 45, 46 so as to smoothly and continuously move the slide 14 along the pole 11.

Although the present invention has been described with respect to the preferred embodiments, it is contemplated that a variety of modifications, variations and substitutions may be done without departing from the scope of the present invention that is intended to be defined by the appended claims.

What is claimed is:

1. An umbrella comprising:

a tubular pole having a lower end mounted to a base;

a slide attached to and movable along the pole;

a tubular arm having a proximate end pivotally connected to the slide and an opposite remote end;

a link having opposite ends respectively pivotally connected to the pole and the arm whereby when the slide is moved along the pole, the arm is driven to rotate about the pivotal connections with the slide and the link between an open position and a closed position;

a crank driving device mounted to the pole comprising an axle drivingly coupled to a crank member located outside the pole;

a rope system comprising a primary rope and a secondary rope, the primary rope being movably received in the pole and arranged between a first pulley and the axle of the crank driving device to be driven by the crank member, the primary rope being coupled to the slide whereby when the primary rope is actuated, the slide is moved along the pole, the secondary rope extending through the arm and having a proximate end fixed to the pole via a second pulley mounted on the slide and a remote end having a length extending beyond the remote end of the arm whereby when the slide is moved along the pole, the length of the remote end of the secondary rope extending beyond the remote end of the arm changes;

a panel means comprising a crown movable with respect to the remote end of the arm, a panel attached to the crown, ribs radially extending from the crown for supporting the panel, a runner spaced from and movable with respect to the crown and stretchers connecting the runner to the ribs, the crown defining a through hole through which the length of the remote end of the secondary rope extends for being attached to the runner whereby when the slide is moved along the pole, the length of the remote end of the secondary rope changes causing the runner to move toward/away from the crown for opening/closing the panel via the stretchers and the ribs;

means for fixing the crown to the remote end of the remote end of the arm when the arm is at the open position whereby further moving the slide in a direction consistent with movement of the arm from the closed position to the open position causes the panel means to rotate with the arm and thus adjusting orientation of the panel means; and locking means for fixing the secondary rope at a secured position corresponding to the open position of the arm, the locking means comprising a locking block arranged inside the arm for forcibly engaging with the secondary rope and thus fixing the secondary rope.

2. The umbrella as claimed in claim 1, wherein the remote end of the arm forms a pair of first tabs spaced from each other, a third pulley is rotatably supported between the first tabs of the arm by a pivot pin for guiding the remote end of the secondary rope toward the crown, the crown forming a pair of spaced second tabs defining aligned slots for movably receiving opposite ends of the pivot pin for guiding the movement of the crown with respect to the remote end of the arm, grooves being defined in the crown for receiving the first tabs therein when the crown is moved to the remote end of the arm thereby securely fixing the panel means to the remote end of the arm.

3. The umbrella as claimed in claim 1, wherein the primary rope comprises a timing belt and a chain.

4. The umbrella as claimed in claim 3, wherein the first pulley and the axle of the crank member comprise toothed wheels.

5. The umbrella as claimed in claim 1, wherein the locking means comprises a locking member supported in the arm of an eccentric shaft coupled to a knob located outside the arm, whereby by rotating the knob, the locking member is driven by the eccentric shaft to forcibly engage the secondary rope.

6. The umbrella as claimed in claim 1, wherein the locking means comprises support member supporting two locking blocks in the arm, a bar mounted to the support member and having an end extending beyond the arm with a nut attached thereto, whereby by rotating the nut, the locking blocks are driven by the bar to forcibly engage the secondary rope.

7. The umbrella as claimed in claim 1, wherein the crank driving device comprises an input gear mounted to the axle and two output gears mating the input gear to be driven thereby in opposite directions, ends of the primary rope being fixed to and partially wound around shafts of the output gears whereby when the input gear is rotated by the crank member, the output gear rotate in opposite direction to respectively unwind and further wind the ends of the primary rope and thus moving the slide along the pole.

* * * * *